US006415447B1

(12) United States Patent
Frazier

(10) Patent No.: US 6,415,447 B1
(45) Date of Patent: Jul. 9, 2002

(54) LEAKPROOF AND BREATHABLE HAND COVERING AND METHOD OF MAKING THE SAME

(75) Inventor: James Frazier, Hinesburg, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/448,718

(22) Filed: Nov. 24, 1999

(51) Int. Cl.[7] ..... A41D 19/00
(52) U.S. Cl. ..... 2/165; 2/161.6; 2/163
(58) Field of Search ..... 2/16, 159, 161.6, 2/163, 164, 165, 167, 169, 158

(56) References Cited

U.S. PATENT DOCUMENTS

| | | | | |
|---|---|---|---|---|
| 3,953,566 A | | 4/1976 | Gore | |
| 3,961,377 A | * | 6/1976 | Lars-Jos | 2/169 |
| 4,021,640 A | | 5/1977 | Gross et al. | |
| 4,051,572 A | | 10/1977 | Greenwood | |
| 4,430,759 A | | 2/1984 | Jackrel | |
| 4,519,098 A | | 5/1985 | Dunmire et al. | |
| 4,545,841 A | | 10/1985 | Jackrel | |
| 4,583,248 A | | 4/1986 | Edwards et al. | |
| 4,594,736 A | | 6/1986 | Connelly | |
| 4,608,114 A | | 8/1986 | Nakao | |
| 4,654,896 A | * | 4/1987 | Rinehart | 2/163 |
| 4,660,228 A | | 4/1987 | Ogawa et al. | |
| 4,662,006 A | | 5/1987 | Ross, Jr. | |
| 4,679,257 A | | 7/1987 | Town | |
| 4,733,413 A | * | 3/1988 | Dykstra | 2/169 |

(List continued on next page.)

FOREIGN PATENT DOCUMENTS

| | | | | |
|---|---|---|---|---|
| EP | 0 611 529 A1 | | 8/1994 | |
| FR | 920.595 | | 4/1947 | |
| GB | 1 379 635 | | 1/1975 | |
| GB | 2 176 741 A | | 1/1987 | |
| GB | 2176741 | * | 1/1987 | 2/161.7 |
| GB | 2 305 391 A | | 4/1997 | |
| JP | 6-33303 | | 2/1994 | |
| WO | WO 92/07480 | | 5/1992 | |

*Primary Examiner*—Peter Nerbun
*Assistant Examiner*—Katherine Moran
(74) *Attorney, Agent, or Firm*—Wolf, Greenfield & Sacks, P.C.

(57) ABSTRACT

An article of clothing, such as a hand covering, and method of making the same results in a leakproof and breathable article of clothing with good dexterity. The hand covering includes a body cavity for covering a palm and a dorsum of a hand and at least one seamed finger cavity, extending from the body cavity, for covering at least one finger. The finger cavity has a base adjacent the body cavity and a tip opposite the base. A seam extends between and includes the area of the base and the tip. A cut may be made in the hand covering so that a component of a tape sealing machine may be inserted therein to support the seam to be sealed. Once this seam is sealed, the cut is seamed and sealed. The hand covering may therefore sealed using a single tape sealing machine to effectively seal all seams while minimizing manufacturing costs.

119 Claims, 11 Drawing Sheets

U.S. PATENT DOCUMENTS 4,831,667 A 5/1989 Town
4,847,918 A 7/1989 Sturm
4,908,879 A 3/1990 Roderman
4,918,756 A 4/1990 Grillot et al.
4,962,547 A 10/1990 Minnick
5,020,161 A 6/1991 Lewis, Jr. et al.
5,123,119 A 6/1992 Dube
5,167,038 A 12/1992 Rinehart
5,231,700 A 8/1993 Cutshall
5,349,705 A 9/1994 Ragan
5,378,529 A 1/1995 Bourdeau
5,402,540 A 4/1995 Williams
5,415,924 A 5/1995 Herlihy, Jr.
5,483,703 A 1/1996 Williams
5,498,472 A 3/1996 Gold
5,529,830 A 6/1996 Dutta et al.
5,560,044 A 10/1996 Masley
5,566,405 A 10/1996 Masley
5,568,656 A * 10/1996 Kim ..... 2/164
5,603,119 A 2/1997 Rinehart
5,614,302 A 3/1997 Nance, Jr.
5,631,074 A 5/1997 Herlihy, Jr.
5,636,382 A 6/1997 Chopko et al.
5,650,225 A 7/1997 Dutta et al.
5,655,226 A 8/1997 Williams
5,682,613 A 11/1997 Dinatale
5,706,519 A 1/1998 Cooper
5,721,283 A 2/1998 Howard, Jr. et al.
5,732,413 A 3/1998 Williams
5,740,551 A 4/1998 Walker
5,766,400 A 6/1998 Gallagher, Jr.
5,804,011 A 9/1998 Dutta et al.
5,822,795 A 10/1998 Gold
5,832,539 A 11/1998 Williams
5,920,908 A 7/1999 Widdemer
5,924,137 A * 7/1999 Gold ..... 2/161.1
5,981,019 A 11/1999 Gooodwin et al.
6,154,886 A * 12/2000 Hottner ..... 2/169

* cited by examiner

LEAKPROOF AND BREATHABLE HAND COVERING AND METHOD OF MAKING THE SAME

BACKGROUND OF THE INVENTION

1. Field of the Invention

The invention relates to articles of clothing, and more particularly to leakproof and breathable hand coverings and methods of making the same.

2. Related Art

Outdoor activities, such as snowboarding, skiing, skating, biking, hiking, snowmobiling, hunting, firefighting, and construction working, to name a few, as well as other activities that expose the wearer to the elements and demand highly aerobic exertion, typically require garments having certain desired performance characteristics. For example, waterproof garments are desirable to keep the wearer dry. However, the waterproof garment should allow vapor from perspiration to readily pass through, therefore allowing the garment to "breathe." In addition, the garment should be lightweight to allow freedom of movement yet, with respect to cold weather activities, it should insulate. Attempts at meeting these sometimes competing characteristics have been implemented in a variety of garments produced by a variety of manufacturing methods.

One attempt at such a garment is a waterproof and breathable hand covering that keeps the wearer's hands warm and dry while permitting perspiration to pass through. The most common such hand covering typically includes a three-piece construction having an outer liner, a waterproof and breathable insert and an insulating liner. However, the applicant has recognized that the resulting three-piece hand covering construction is bulky, restricting movement and therefore provides little dexterity.

Other hand coverings that do offer increased dexterity do not offer complete waterproofing. Such hand coverings typically include a two-piece construction having an outer waterproof and breathable shell, and an insulating liner. The outer shell is typically constructed of two or more pieces of waterproof and breathable material sewn together in a manner resulting in a non-leakproof seam about each finger cavity. The seam extends from the base of the finger cavity, up one side of the finger cavity through the tip of the finger cavity then down the other side and back to the base. The seam then continues about an adjacent finger cavity. The seams are then sealed using heat activated adhesive seam sealing tape fused to the seam using a tape sealing machine. However, the seam situated at the tip of the finger cavity cannot be efficiently taped and the seam situated at the base between adjacent finger cavities cannot be taped at all, primarily due to the construction of the tape sealing machine, as will now be explained.

In tape sealing machines, the sealing tape is pressed onto a flat seam of a garment by passage of the tape and the seam together between rotating rollers of the machine. The rollers are attached to mounts, such as axles or tractor-feed mechanisms, that axially extend to one side of the rollers. The tape and seam are pressed between the rollers in a manner such that one roller rolls along the seam on one side of the garment to apply the appropriate pressure to the tape and seam and the other roller rolls along the seam on the opposite side of the garment to act as a support. These tape sealing machines are effective for relatively flat seams because the garment may extend in the direction of the mounts. Thus, the mounts do not interfere with the garment. As a result, the seam and tape can easily pass through and be pressed by the rollers. When sealing the seams extending along the length of the finger cavity of a glove or mitten, for example, the finger cavity is flattened such that two layers of garment (i.e., each side of the finger cavity) pass through the rollers simultaneously, although only one side is sealed at a time. The finger cavity is then flipped over and the seam on the opposite side of the finger cavity is sealed, which also requires the finger cavity to be flattened such that both sides of the finger cavity pass through the rollers simultaneously. Here too, the roller mounts do not interfere with the flattened finger cavity.

As stated above, these tape sealing machines are limited with respect to taping relatively tightly radiused seams, such as those near the tips or the bases of the fingers of the glove or mitten. The tightly radiused seam cannot be pressed between the rollers, as is required for an effective seal. In this respect, neither the finger cavity nor the tightly radiused seam can be flattened in a manner to allow the support roller to be positioned behind the tightly radiused seam to support the seam. In addition, because a small cavity is typically associated with a tightly radiused seam, such as the small finger cavity associated with the tip thereof, the cavity cannot be placed over both the support roller and the associated mount in a manner to allow the support roller to support the tightly radiused seam. Therefore, with respect to the tightly radiused seam at the base, no seal may be formed. With respect to the tightly radiused seam at the tip, a secondary operation is required to seal the tip.

One such secondary operation is disclosed in U.K. Patent Application GB 2,176,741 (hereinafter referred to as '741). The '741 application recognizes that tape sealing machines utilizing two rollers are limited with respect to producing an effective seal at the tip of a finger cavity of a glove. The application therefore discloses a specialized apparatus to apply pressure to the sealing tape located at the tip. The apparatus includes a male tool, which substantially conforms to the tip of the finger cavity, and a complementary shaped female tool, both mounted to a press. Initially, heat activated adhesive tape is laid along the seam as far as possible up to the tightly radiused tip of the finger cavity and is pressed between rollers of a seam sealing machine. The glove is then transferred to the specialized apparatus disclosed in '741 where the finger cavity is placed over the male tool and is pressed against the complimentary shaped female tool to apply localized pressure at the tip to adhere the tape.

SUMMARY OF THE INVENTION

The present invention is therefore directed to an article of clothing, such as a hand covering, and a method of making the same that overcomes the above noted and other disadvantages of prior articles of clothing and methods of producing such articles of clothing. The present invention results in an article of clothing that is leakproof and breathable with good dexterity. The article of clothing may be sealed by the same seam sealing machine to effectively seal all seams, thereby ensuring the leakproof characteristics of the article of clothing, while minimizing manufacturing costs. In this respect, the applicant has found that constructing a hand covering in a suitable manner, an example of which is described herein, the rollers and associated mounts of a tape sealing machine may be employed to render a tightly radiused seam amenable to sealing.

In one illustrative embodiment of the invention, a leakproof hand covering is provided. The hand covering includes a body cavity for covering a palm and a dorsum of a hand and at least one finger cavity, extending from the body cavity, for covering at least one finger. The finger cavity is formed of at least two segments of material each having a base adjacent the body cavity and a tip opposite the base. The at least two segments are joined with a seam between and including the base and the tip. The seam is joined in a non-leakproof manner. A seal is then formed over the seam between and including the base and the tip, rendering the seam leakproof.

In another illustrative embodiment of the invention, a hand covering is provided. The hand covering includes a palmar surface material having a palmar hand surface portion that is shaped to cover the palm of the hand. At least one palmar finger surface portion extends from the palmar hand surface portion and is shaped to cover the palmar finger surface of at least one finger. The hand covering also includes a dorsal surface material having a dorsal hand surface portion, shaped to cover the dorsum of the hand. At least one dorsal finger surface portion extends from the dorsal hand surface portion and is shaped to cover the dorsal finger surface of the at least one finger. The palmar and dorsal surface materials are joined together with at least a first seam. The dorsal finger surface and the palmar finger surface define at least a portion of one finger cavity. A second seam is formed in either the palmar surface material, the dorsal surface material, or both. Although not necessarily constituting part of this embodiment, the second seam results from a cut made in the respective surface portion of the finger cavity such that a component of a seam sealing machine may be placed within the finger cavity to seal the at least first seam.

In yet another embodiment of the invention, a method of making a leakproof article of clothing using a seam sealing machine is disclosed. The seam sealing machine has at least one roller for pressing against a seam. The method includes the steps of seaming at least two segments of material in a non-leakproof manner to form at least a portion of a cavity therebetween. A resulting non-leakproof seam has at least one tightly radiused seam portion. The method further includes applying a sealant to the at least one tightly radiused seam portion using the at least one roller of the seam sealing machine. Thus, the at least one tightly radiused seam portion of the non-leakproof seam becomes leakproof.

In still another embodiment of the invention, a method of making a hand covering is provided. The method includes the steps of seaming at least two segments of material to form a body cavity having a palmar surface for covering a palm of the hand and a dorsal surface for covering a dorsum of the hand and at least one finger cavity extending from the body cavity having at least a palmar surface and at least a dorsal surface respectively, for covering at least one finger. The seamed segments of material define at least a first seam. The finger cavity defines a base adjacent the body cavity and a tip area opposite the base. The method further includes the steps of cutting at least one surface of the finger cavity, and seaming the cut resulting from the cutting step to form a second seam. Although not necessarily constituting part of this embodiment, once the at least one surface is cut, a component of a seam sealing machine may be used to seal the at least first seam.

In another illustrative embodiment of the invention, a method of making a leakproof article of clothing using a seam sealing machine is disclosed. The seam sealing machine has first and second rollers for pressing a seam therebetween. The method includes the steps of seaming at least two segments of material in a non-leakproof manner to form at least a portion of a cavity therebetween. The resulting non-leakproof seam having at least one tightly radiused seam portion. The method further includes the step of inserting the first roller into the cavity to support the at least one tightly radiused seam against the second roller and applying a sealant to the at least one tightly radiused seam portion using the second roller, thereby causing at least the at least one tightly radiused seam portion of the non-leakproof seam to become leakproof.

In another illustrative embodiment of the invention, a hand covering is provided. The hand covering includes a body cavity for covering a palm and a dorsum of a hand and at least one finger cavity extending from the body cavity for covering at least one finger. The finger cavity is formed of palmar surface for covering a palmar surface of the finger and a dorsal surface for covering a dorsum surface of the finger. A non-leakproof seam joins the palmar and dorsal surfaces of the finger cavity. The non-leakproof seam has a tightly radiused portion. An access opening is configured and arranged to receive a tool that contacts the non-leakproof seam about the tightly radiused portion.

Further features and advantages of the present invention as well as the structure and method of making various embodiments of the present invention are described in detail below with reference to the accompanying drawings.

BRIEF DESCRIPTION OF THE DRAWINGS

Various embodiments of the invention will now be described, by way of example, with reference to the accompanying drawings, in which.

DETAILED DESCRIPTION

The present invention is directed to an article of clothing, such as a hand covering, and method of producing the same that is leakproof and breathable with good dexterity. The article of clothing may be sealed using rollers of the same seam sealing machine to effectively seal all seams, thereby ensuring the leakproof characteristics of the article of clothing while minimizing manufacturing costs. A cut may be made along the length of the article of clothing adjacent the tightly radiused seam. The cut is made so that one of the rollers, with its related mounting component may support a tightly radiused seam so that the seam may be pressed between the rollers. The cut may be subsequently seamed and sealed.

Although the inventive article of clothing to which this patent is addressed is discussed below particularly in connection with a hand covering, such as a glove or mitten, it should be appreciated that the present invention is not limited in this respect, and that the aspects of the present invention described below may be used in association with other types of articles of clothing such as footwear, headwear, bodywear, etc.

Figure 1:
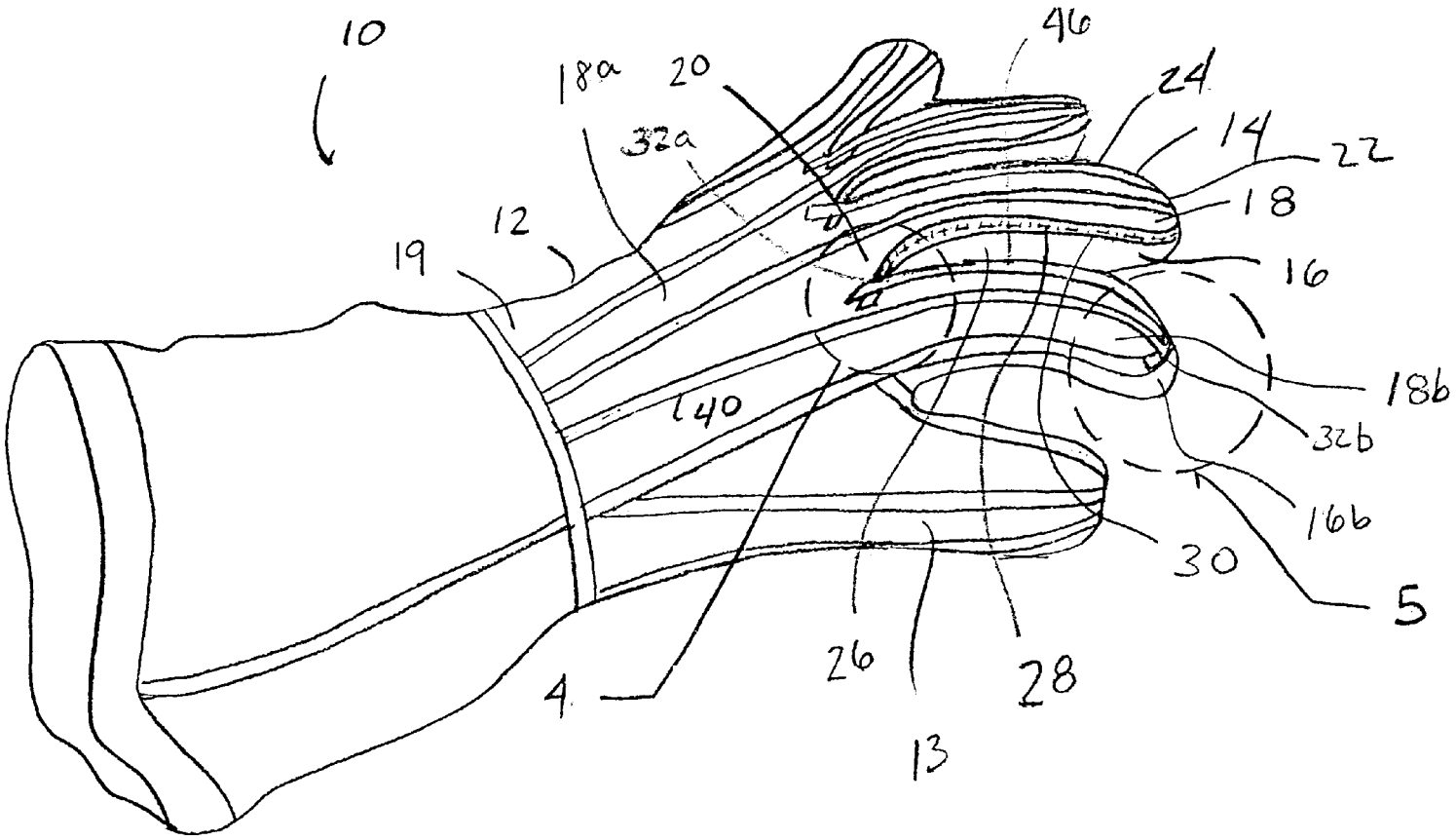
FIG. 1 is a perspective view of a leakproof hand covering according to one embodiment of the present invention.

FIG. 1 shows one illustrative embodiment of the invention, specifically a perspective view of a leakproof and breathable hand covering 10, such as a right-hand glove turned inside-out. As used herein, the term "leakproof" and any derivative thereof means that the item to which the term refers is impervious to liquid within a desired level. A typical measurement for an item that is leakproof is the amount of surface pressure (in psi) that an item may withstand for a period of about 2 minutes. In addition, as used herein, the term "breathable" and any derivative thereof means that the item to which the term refers allows vapor to readily pass therethrough. A typical measurement for an item that is breathable is Relative Evaporative Transfer (RET), measured in grams of vapor transfer per square meter in a 24 hour period. An item may be considered breathable if less than about 60 RET. In this respect, the hand covering and/or the sealed seams used to form the hand covering may withstand a desired leakproof level of about 14 psi for two minutes, although a higher or lower level may be provided. In addition, the hand covering and/or the sealed seams used to form the hand covering may also withstand a desired breathable level of between about 50 RET to about 60 RET, although a higher or lower range may be provided.

Figure 1A:
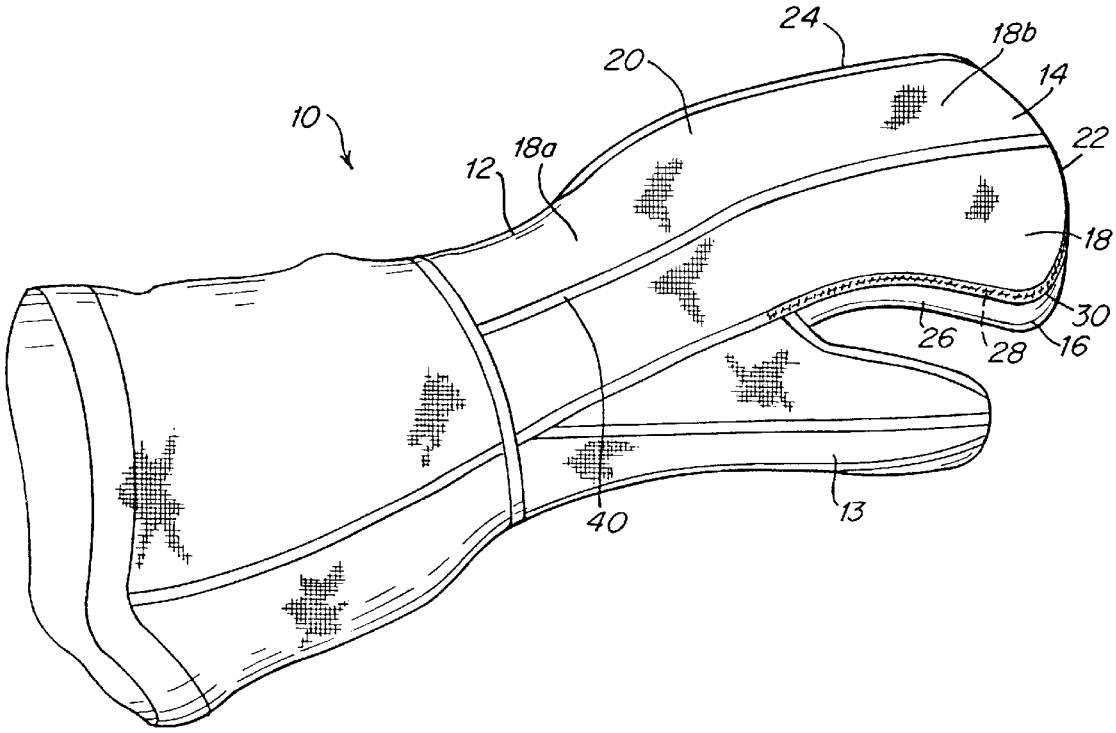
FIG. 1A is a perspective view of a leakproof hand covering according to another embodiment of the present invention.

The hand covering 10 includes a body cavity 12 for covering a palm and a dorsum of a hand and at least one finger cavity 14, extending from the body cavity 12, for covering at least one finger. As shown in FIG. 1, five finger cavities are provided, including one thumb cavity 13. However, the present invention may be implemented in a mitten, in which case two finger cavities are provided, as shown in FIG. 1A. Of course, any number of finger cavities may be implemented, with or without a separate thumb cavity. At least a portion of a finger cavity 14 may be formed of at least two panels or segments of leakproof and breathable material 16, 18 joined together. An example of such a material is expanded polytetrafluoroethylene (PTFE) available under the name Gore-Tex® from W.L. Gore & Associates, Inc, Newark Del.

In the example described with reference to FIG. 1, two segments of material are joined together to completely form the finger cavity. Each finger cavity 14 has a base 20 adjacent the body cavity 12, a tip 22 opposite the base 20 and first and second side portions 24, 26 extending between the tip 22 and the base 20. The segments of material forming the finger cavity 14 form a palmar (or front) surface and a dorsal (or back) surface, respectively. The two segments 16, 18 are joined with a seam 28 (shown in phantom) that may extend along the first and second side portions 24, 26 of the finger cavity 14 between and including the base 20 and the tip 22. For the sake of clarity, only the portion of the seam 28 extending between the base and tip on one side of one finger cavity is shown. It is to be appreciated, however, that the seam 28 may extend about all finger cavities.

The two segments 16, 18 are joined together using conventional techniques, such as sewing. A sewn seam is non-leakproof because of the holes created in the segments of material to be joined as well as the resulting non-uniform interface, both of which allow water or other fluids to leak into the body and finger cavities 12, 14. A seal 30 is then formed completely over the non-leakproof seam 28, thereby causing the seam to become leakproof. The seal 30 extends between and includes the base 20 and the tip 22 such that the entire seam 28 joining the segments 16, 18 together may be sealed.

It should be appreciated that the present invention is not limited to sewn seams, and that other non-leakproof joining techniques may be used, such as discontinuous fusing of the two segments, adhesive bonding, weaving, and phase changing the membrane of the garment with heat and/or pressure. In addition, no joined seam need be provided, rather, once sealed, the seal acts to join the two segments.

Figure 2A:
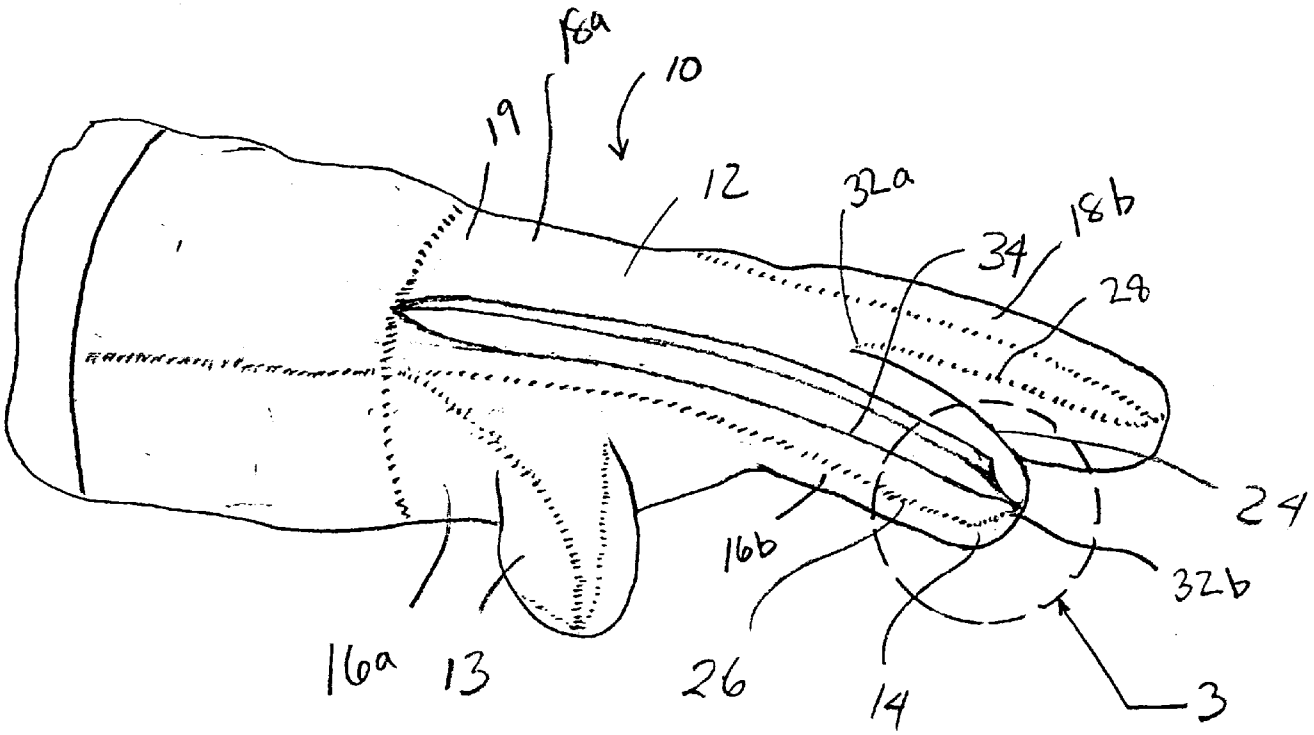
FIG. 2*a* is a perspective view of the leakproof hand covering shown in FIG. 1 at a slightly different angle.

Referring now to FIG. 2*a*, which is a perspective view of the leakproof hand covering 10 shown in FIG. 1 at a slightly different angle, the two segments of material 16, 18 may extend to the body portion 12 up to a wrist area 19, as shown. In this manner, the palmar surface 16 has a palmar hand surface portion 16*a* shaped to cover the palm of the hand, and at least one palmar finger surface portion 16*b* extending from the palmar hand surface portion 16*a* shaped to cover the palmar finger surface of at least one finger. The dorsal surface 18 has a dorsal hand surface portion 18*a* shaped to cover the dorsum of the hand and at least one dorsal finger surface portion 18*b* extending from the dorsal hand surface portion 18*a* shaped to cover the dorsal finger surface of the at least one finger.

However, it should be appreciated that the present invention is not limited in this respect, and that the body cavity 12 may be constructed of separate additional segments joined with the finger cavities 14. Similarly, although two segments are shown in the construction of the finger cavity 14, additional segments may be used, such as side segments, thereby forming a box-like finger cavity. The present invention is not limited in this respect, and that only one segment of material may be used, provided that such a segment includes a seam made or to be made leakproof according to certain aspects of the present invention.

Figure 2B:
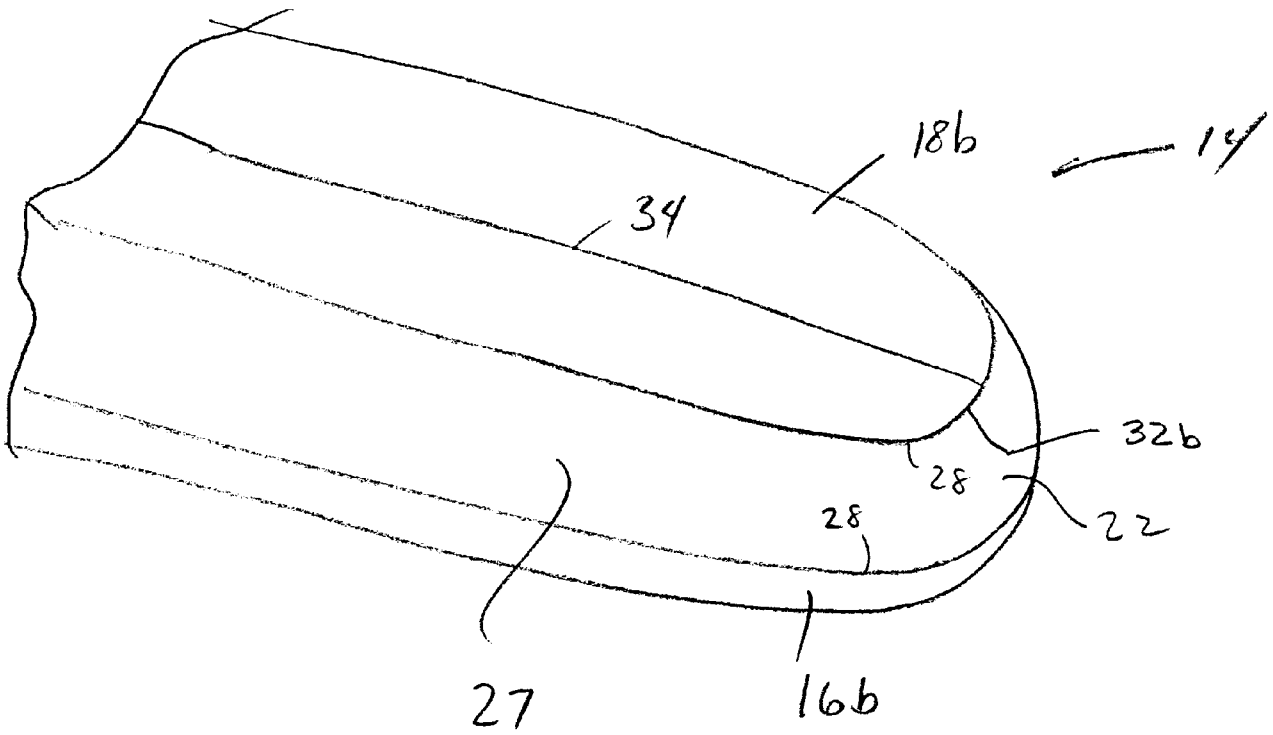
FIGS. 2*b*–2*d* are perspective views of alternative embodiments showing a portion of the leakproof hand covering shown in FIG. 1.
Figure 2C:
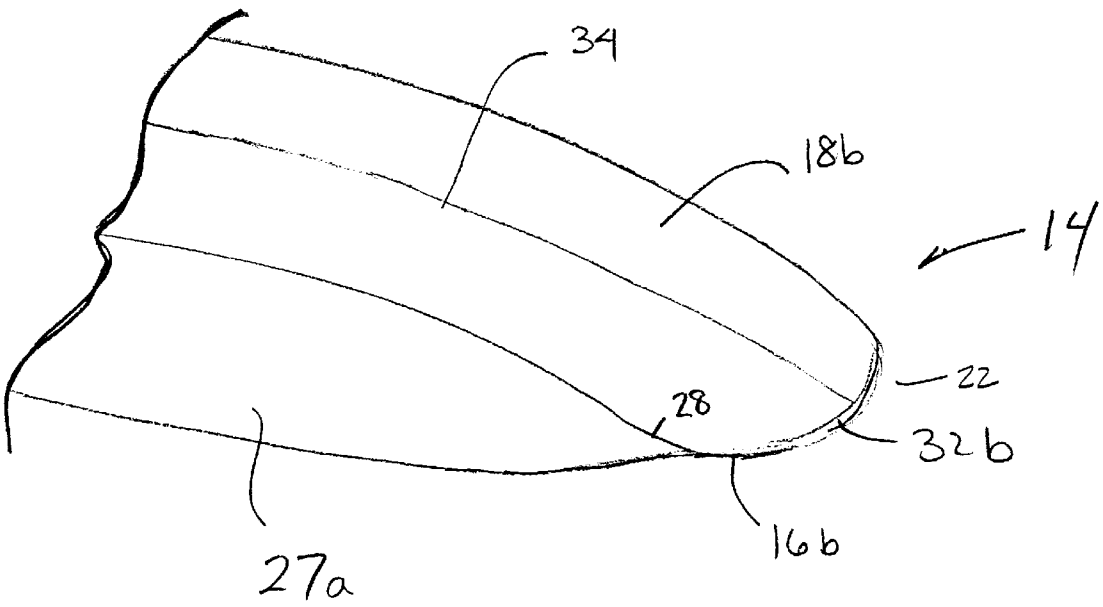

One such multi-segment construction is shown in FIG. 2*b* and is typically referred to as a fourchette style glove wherein the finger cavity includes a side segment 27 continuously formed between the sides of the finger cavity and over the finger tip area. Another similar fourchette style glove construction is shown in FIG. 2*c*. In this example, the finger cavity includes two discrete side segments 27*a* and 27*b* (only one of which is shown), one on each side of the finger cavity. Unlike the previously described fourchette style glove, in this example, the tip of the finger cavity 14 is formed from the dorsal 18*b* and palmar 16*b* surfaces tapering toward each other at the finger tip area and seamed together.

Figure 2D:
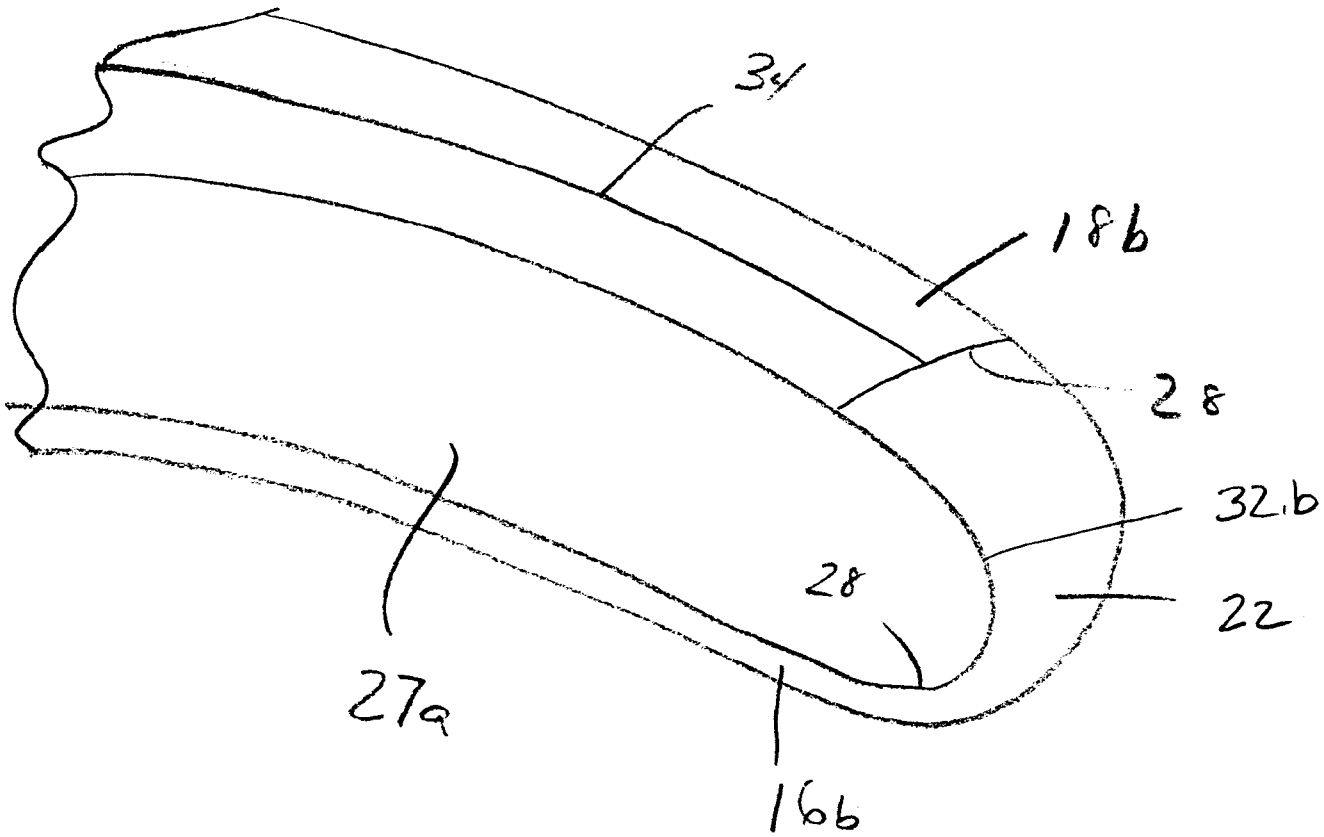

In yet another example, a modified fourchette style glove construction may be provided. As shown in FIG. 2*d*, the finger cavity may be formed by joining the palmar surface material 16*b* at a location spaced adjacent the finger tip area 22. Preferably, as shown, the palmar surface material 16*b* and the dorsal surface material 18*b* are joined at a location on the dorsal surface of the finger cavity. However, it should be appreciated that the present invention is not limited in this respect. Instead, the palmar surface material 16*b* and the dorsal surface material 18*b* may be joined at a location on the palmar surface of the finger cavity. In any event, once the surface materials 16*b* and 18*b* are joined, the finger cavity may be completed by joining side segments 27*a* and 27*b* (only one of which is shown) to the surface materials 16*b* and 18*b*. It is to be appreciated that the order of joining the surface materials and side segments is for illustrative purposes only and that other suitable sequences may be performed, such as first joining the side segment to the surface materials, then joining the two surface materials together.

In each of the above-noted glove constructions, the finger cavity may be formed as a clute-cut construction. In such a construction, as is well-known, the dorsal surface of the finger cavity is made longer than the respective palmar surface. As a result, the finger cavity has, in a relaxed state, the contour of a relaxed finger (i.e., curved). An illustrative example of such a clute-cut construction is shown in FIG. 2*d*.

Figure 3:
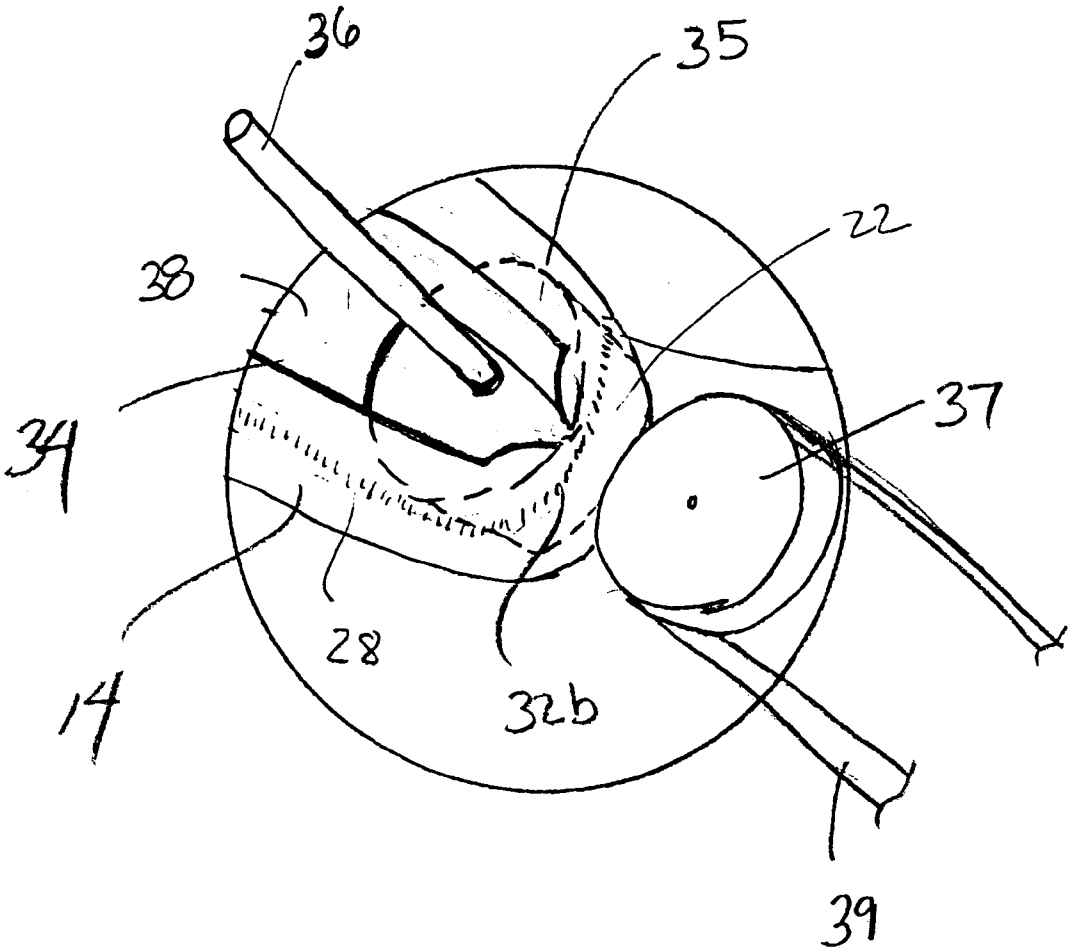
FIG. 3 is an enlarged view of the area encircled by line 3 of FIG. 2*a*.

The seam 28 formed at the base and the tip includes tightly radiused seams 32*a* and 32*b*, respectively. The tightly radiused seams 32*a* and 32*b* are sealed using rollers of a seam sealing machine. An example of such a seam sealing machine is a tractor-feed tape sealing machine used in production of waterproof bootees. Such machine are available from W.L. Gore & Associates, Inc. of Newark, Del. as well as from other companies. Although such a machine may have rollers and associated bootee tractor-foot attachments sized for footwear such as bootees, suitable size and other adjustments may be made, if necessary, so that the rollers and related components may be used with the hand covering of all sizes. An access opening, such as a cut 34, may be made in the finger cavity 14. In one illustrative embodiment, the cut 34 extends along the length of the finger cavity 14. The cut 34 is made so that one of the rollers with its related mounting component may support a tightly radiused seam so that the seam may be pressed between the rollers, as shown in FIG. 3, which is an enlarged view of the area encircled by line 3 of FIG. 2*a*. One roller 35 of the seam sealing machine (not shown) may be placed through the cut 34 into the resulting cavity 38. A mounting component 36 (such as an axle or tractor-feed mechanism) of the sealing machine that holds the support roller extends outward from the resulting cavity 38. Another roller 37, which presses the sealant against the seam, remains outside the resulting cavity 38. The tightly radiused seam (32*b*, for example) to be made leakproof may therefore be pressed between the rollers 36, 37 and sealed. As is known to those skilled in the art, the roller 37 may cooperate with a tractor feed-type belt 39, which may be used to aid in the application of the sealant. Once sealed, the cut 34 may be seamed and sealed with a sealant 40, as shown in FIG. 1, thereby becoming leakproof.

It is to be appreciated that, because the hand covering may be turned inside-out to facilitate seaming and sealing, the resulting cavity 38 is not part of the finger cavity or the body cavity, but rather is a temporary cavity available during manufacture of the hand covering. Once the hand covering is inverted, the cavity 38 no longer exists and the seals are disposed within the body and finger cavities. Having said this, however, the hand covering need not be inverted and the seals may be permanently positioned on the outside of the hand covering.

Continuing again with reference to FIG. 2*a*, the cut 34 may extend along the longitudinal length of the palmar surface 16 and has a length sufficient to allow the rollers to move along the length of the seam to be sealed. In this respect, the length of the cut is sufficient to allow the tip 22, the base 20 or both to be sealed with the seam sealing machine. In particular, the hand covering 10 can travel relative to the roller 36 along the length of the cut 34 to seal the side seams between and including the tip and the base. In one embodiment, the cut 34 extends at least between the area of the tip 22 and the area of the base 24 of the finger cavity 14 and may be positioned between the first and second side portions 24, 26 of the finger cavity 14, preferably substantially equidistant from each side. In an alternative embodiment, the cut extends to the wrist area 19 of the body cavity 12. In yet another embodiment, the cut,34 extends into the tightly radiused seam 32*b* at the tip 22.

It is to be appreciated that, although the cut 34 is shown to be disposed through the dorsal surface 18, the cut may be disposed through the palmar surface 16 or both the dorsal and palmar surfaces, as desired. In addition, although the cut 34 is shown as a continuous cut, it may be formed of two or more discontinuous cuts, each positioned and sized to accommodate sealing of the tip and/or the base.

Figure 4:
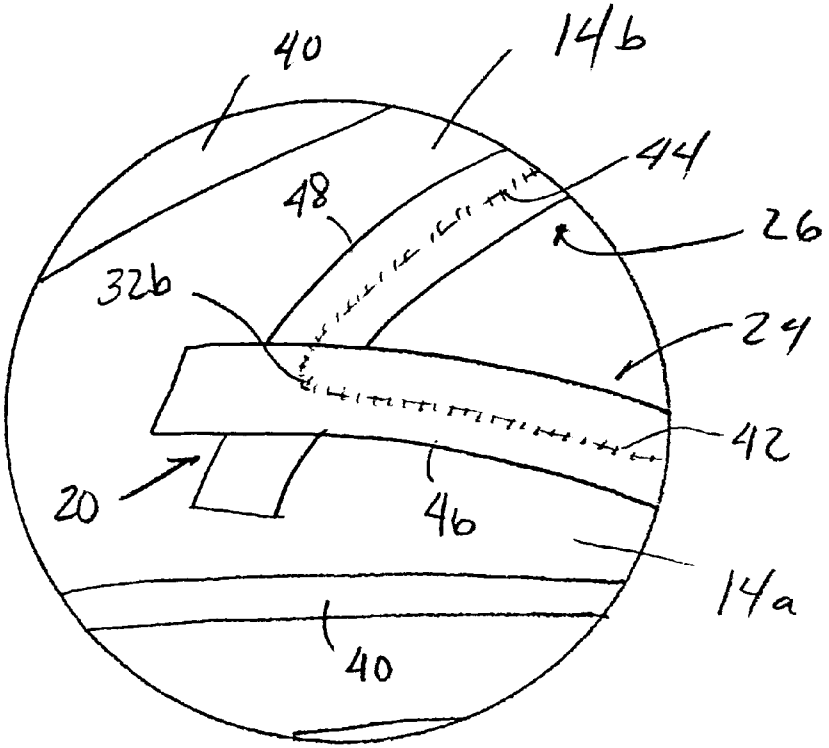
FIG. 4 is an enlarged view of the area encircled by line 4 of FIG. 1.
Figure 5:
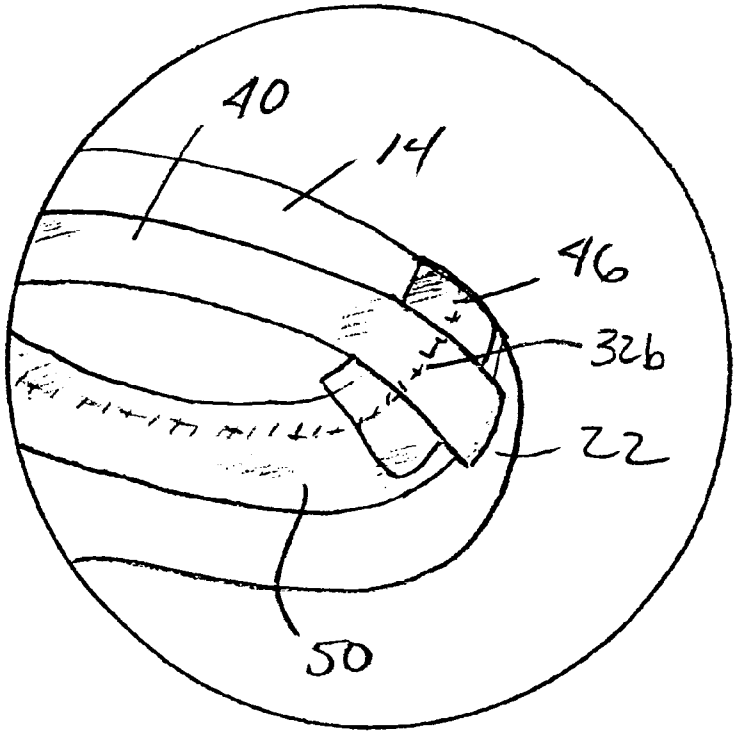
FIG. 5 is an enlarged view of the area encircled by line 5 of FIG. 1.

When the hand covering is formed as a glove or mitten, at least two adjacent finger cavities 14 are provided and share a common base 20. As best shown in FIG. 4, which is an enlarged view of the area encircled by line 4 of FIG. 1, the common base 20 includes a tightly radiused seam 32*a* bridging the seam 42 (shown in phantom) extending along side 24 of one finger cavity 14*a* and the seam 44 (shown in phantom) extending along side 26 of the adjacent finger cavity 14*b*. Seams 42 and 44 form part of the seam 28 shown and described with respect to FIG. 1. A first seal 46 may be formed over the seam 42 to extend along the side of one finger cavity and a second seal 48 may be formed over the seam 44 to extend along the side of the adjacent finger cavity. The seals are therefore discontinuous at the common base 20 but overlap each other, preferably in a crisscross pattern, to seal the common base 20. Similarly, as best shown in FIG. 5, which is an enlarged view of the area encircled by line 5 of FIG. 1, the seal formed over the tightly radiused seam 32*b* (shown in phantom) at the tip 22 of the finger cavity 14 may also be discontinuous, thereby defining two separate seals 46 and 50, each of which extend along the sides of the finger cavity 14. The two seals 46, 50 overlap each other at the tip to seal the tip 22.

Each seal extending between and including the base 20 and the tip 22 along a side of a finger cavity, for example seals 46, 48 and 50, is preferably a single continuous seal, as shown. However, each seal may be discontinuous in that they may be made up of two or more seal segments, abutting or overlapping each other, for example. Forming the seal as a continuous seal may be possible partly due to the fact the hand covering may move relative to the roller in a continuous manner along the cut to support the side seam along the entire length thereof.

Figure 6:
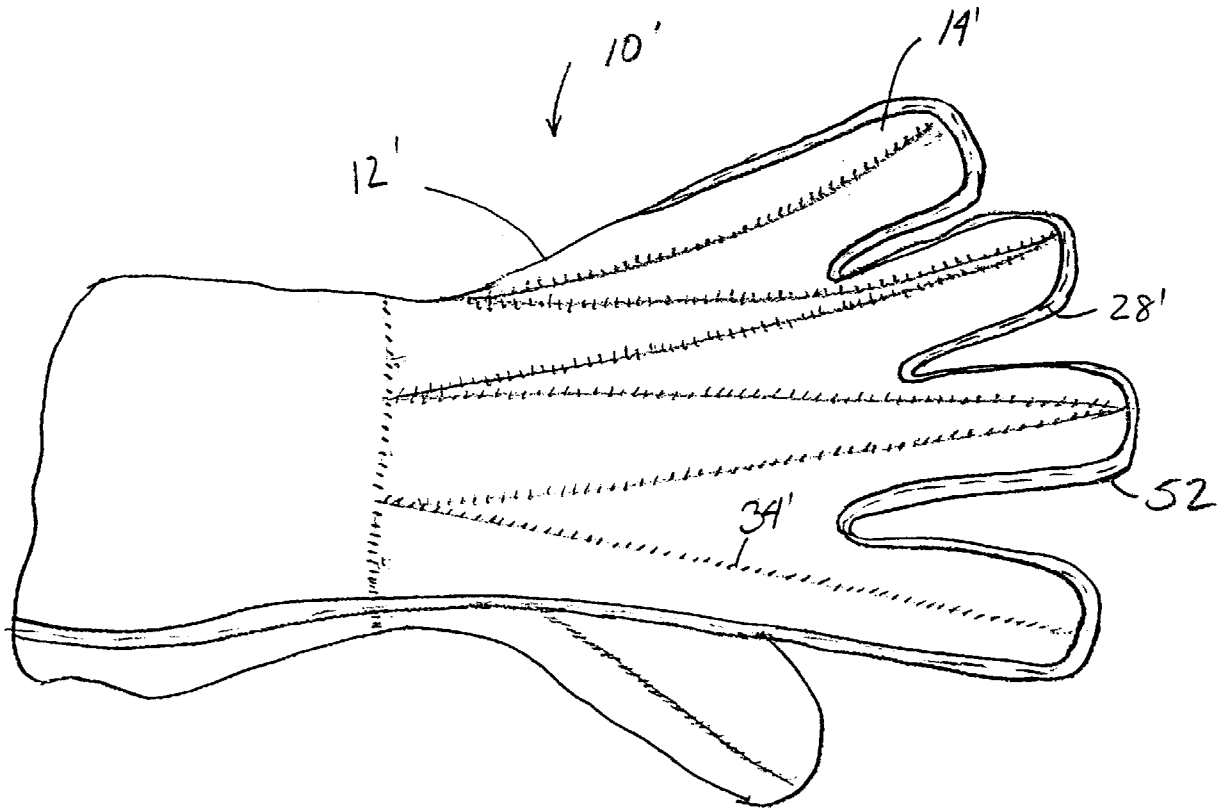
FIG. 6 is a top view of a hand covering according to another embodiment of the present invention; and, FIG. 7 is an exploded perspective view showing a liner used for insertion into the hand covering of the present invention.

In some instances, it may be desirable that the entire seal extending between and including the tip of one finger cavity to the tip of the adjacent finger cavity be formed as a continuous seal. In addition, the seal may be continuous from the first finger cavity to the last. This provides for increased leakproof characteristics in that any potential leak paths are minimized while reducing the potential for a somewhat bulky seam that may accompany overlapping seals. An example of such a seal is shown in FIG. 6, which is a view of an alternative embodiment of the hand covering.

In this illustrative embodiment, a hand covering 10' has a body portion 12' and may be formed with a continuous seal 52 extending along seams 28' formed about each of the finger cavities 14'. In order to lay such a continuous seal, the hand covering must be able to move relative to the rollers of the sealing machine, in a continuous manner, through all of the finger cavities. In one illustrative embodiment, a continuous cut 34' (shown seamed in FIG. 6) may be made along the length of a finger cavity 14' in a manner so as to intersect with an adjacent cut made along the length of an adjacent finger cavity. One example of such intersecting cuts results in a zig-zag cut pattern, as shown. Accordingly, at least one roller (not shown) of the seam sealing machine may be placed through the cut 34' into the resulting cavity to support the seam 28' and used to apply a continuous seal over the seam 28', thereby resulting in a leakproof seam.

However, it should be appreciated that the continuous cut 34' may be made in any shaped pattern so long as the hand covering may move relative to the rollers in a continuous manner. In addition, the resulting cut pattern is preferably one in which subsequent seaming and sealing of the cut is easily made. Straight cuts offer such an advantage and therefore, one embodiment results in the zig-zag pattern, as described above.

As previously mentioned, the hand covering may move relative to the roller so as to support the side seam along the entire length of the cut. As a result, a single seam layer may be positioned between the rollers so that the single seam layer may be sealed. Prior attempts at sealing a side seam of a finger cavity required that both seam layers (one on each side of the finger cavity) be placed between the rollers, which may be cumbersome. With a cut formed in the hand covering of the present invention, a single seam layer may be positioned between the rollers.

The hand covering may be sealed using any suitable sealant disposed over the seam, such as, for example, heat activated adhesive seam sealing tape. An example of such a tape is Gore-Tex® seam sealing tape. However, it should be appreciated that the present invention is not limited in this respect, and that the other suitable sealants or sealing methods may be used. For example, a leakproof glue-like material may be disposed over the seam. Alternatively, the hand covering may be sealed by welding or fusing the seam.

Figure 7:
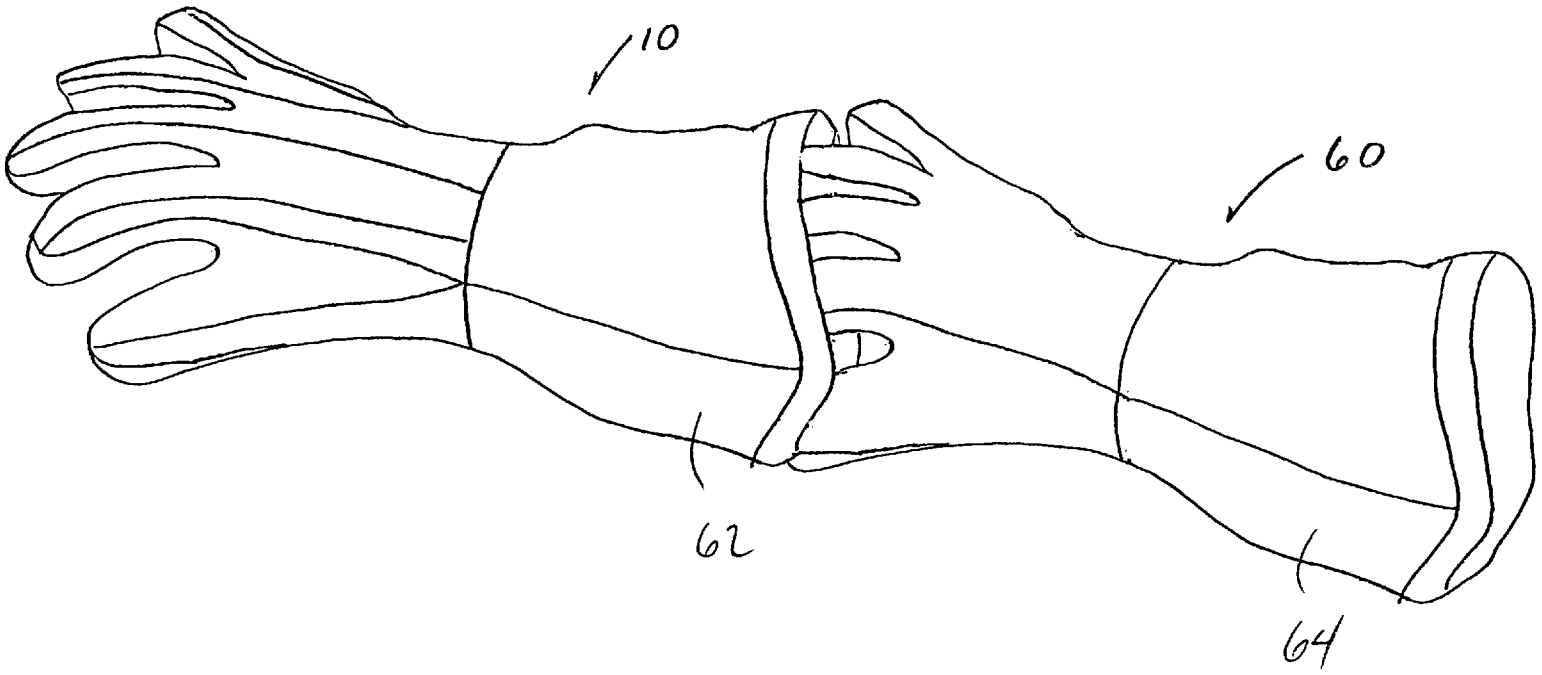

As shown in FIG. 7, which is an exploded perspective view of an alternative embodiment of the present invention, the hand covering 10, specifically the body and finger cavities, form an outer shell. An insulating liner 60, which substantially conforms to the shape of the body and finger cavities, may then be disposed therein. The outer shell or the insulating liner or both may further include a forearm sleeve portion 62 and 64, respectively. Because the seams are sealed as described above, the hand covering therefore may be a moisture liner-free hand covering.

Having thus described certain embodiments of the present invention, various alterations, modification and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. A leakproof hand covering comprising:

a body cavity for covering a palm and a dorsum of a hand;

at least one finger cavity extending from said body cavity for covering at least one finger, said finger cavity formed of at least two segments of material each having a base adjacent said body cavity and a tip opposite said base;

a seam joining said at least two segments of material between and including said base and said tip, said seam joined in a non-leakproof manner; and, a seal formed over said seam to seal said seam between and including said base and said tip, said seam thereby becoming leakproof, wherein said seal is disposed on an inside surface of said cavities.

2. The hand covering according to claim 1, wherein said seal is discontinuous at said tip, thereby defining two separate seals, said two seals overlapping each other.

3. The hand covering according to claim 1, wherein said seal comprises a continuous seal extending between and including said base and said tip along at least one of a first and second sides of said at least one finger cavity.

4. The hand covering according to claim 1, wherein said seal comprises sealing tape.

5. The hand covering according to claim 1, wherein said body cavity and said at least one finger cavity define an outer shell.

6. The hand covering according to claim 1, wherein said hand covering comprises a moisture liner-free hand covering.

7. The hand covering according to claim 1, wherein said hand covering is shaped as a glove.

8. The hand covering according to claim 1, wherein said hand covering is shaped as a mitten.

9. The hand covering according to claim 1, wherein said finger cavity includes a dorsal segment of material joined to a palmar segment of material to completely form said finger cavity.

10. The hand covering according to claim 1, wherein said finger cavity includes a dorsal segment of material, a palmar segment of material and a side segment of material joining said dorsal and palmar segments to completely form said finger cavity.

11. The hand covering according to claim 1, wherein said finger cavity includes a dorsal segment of material joined to a palmar segment of material and first and second side segments of material, each joined to said dorsal and palmar segments of material to completely form said finger cavity.

12. The hand covering according to claim 1, wherein said finger cavity includes a dorsal segment of material joined to a palmar segment of material and first and second side segments of material, each joined to said dorsal and palmar segments of material to completely form said finger cavity, with said dorsal segment of material joining said palmar segment of material at a location spaced from said tip.

13. A leakproof hand covering comprising:

a body cavity for covering a palm and a dorsum of a hand;

at least one finger cavity extending from said body cavity for covering at least one finger, said finger cavity formed of at least two segments of material each having a base adjacent said body cavity and a tip opposite said base;

a seam joining said at least two segments of material between and including said base and said tip, said seam joined in a non-leakproof manner;

a seal formed over said seam to seal said seam between and including said base and said tip, said seam thereby becoming leakproof; and wherein said seam formed at at least one of said base and said tip comprises a tightly radiused seam.

14. The hand covering according to claim 13, wherein said seal is discontinuous said tip, thereby defining two separate seals, said two seals overlapping each other.

15. The hand covering according to claim 13, wherein said seal comprises a continuous seal extending between and including said base and said tip along at least one of a first and second sides of said at least one finger cavity.

16. The hand covering according to claim 13, wherein said seal comprises sealing tape.

17. The hand covering according to claim 13, wherein said body cavity and said at least one finger cavity define an outer shell.

18. The hand covering according to claim 17, further comprising an insulating liner disposed within said outer shell.

19. The hand covering according to claim 13, wherein said hand covering comprises a moisture liner-free hand covering.

20. The hand covering according to claim 13, wherein said hand covering is shaped as one of a glove and a mitten.

21. The hand covering according to claim 13, wherein said finger cavity includes a dorsal segment of material joined to a palmar segment of material to form said finger cavity.

22. The hand covering according to claim 21, wherein said finger cavity includes at least one side segment of material joining said dorsal and palmar segments to form said finger cavity.

23. A leakproof hand covering comprising:

a body cavity for covering a palm and a dorsum of a hand;

at least one finger cavity extending from said body cavity for covering at least one finger, said finger cavity formed of at least two segments of material each having a base adjacent said body cavity and a tip opposite said base;

a seam joining said at least two segments of material between and including said base and said tip, said seam joined in a non-leakproof manner;

a first seal formed over said seam to seal said seam between and including said base and said tip, said seam thereby becoming leakproof;

a longitudinally extending seam extending along a length of said at least one finger cavity between said tip and said body cavity and positioned between first and second sides of said at least one finger cavity; and, a second seal formed over said longitudinally extending seam, said longitudinally extending seam thereby becoming leakproof.

24. The hand covering according to claim 23, wherein said body cavity comprises a wrist area disposed opposite said at least one finger cavity, said longitudinally extending seam extending along from said at least one finger cavity to said wrist area.

25. The hand covering according to claim 23, wherein said first seal is discontinuous at said tip, thereby defining two separate first seals, said two first seals overlapping each other.

26. The hand covering according to claim 23, wherein said first seal comprises a continuous first seal extending between and including said base and said tip along at least one of a first and second sides of said at least one finger cavity.

27. The hand covering according to claim 23, wherein at least one of said first and second so is comprises sealing tape.

28. The hand covering according to claim 23, wherein said body cavity and said at least one finger cavity define an outer shell.

29. The hand covering according to claim 28, further comprising an insulating liner disposed within said outer shell.

30. The hand covering according to claim 23, wherein said hand covering comprises a moisture liner-free hand covering.

31. The hand covering according to claim 23, wherein said hand covering is shaped as one of a glove and a mitten.

32. The hand covering according to claim 23, wherein said finger cavity includes a dorsal segment of material joined to a palmar segment of material to form said finger cavity.

33. The hand covering according to claim 32, wherein said finger cavity includes at least one side segment of material joining said dorsal and palmar segments to form said finger cavity.

34. A leakproof hand covering comprising:

a body cavity for covering a palm and a dorsum of a hand;

at least one finger cavity extending from said body cavity for covering at least one finger, said finger cavity formed of at least two segments of material each having a base adjacent said body cavity and a tip opposite said base;

a seam joining said at least two segments of material between and including said base and said tip, said slam joined in a non-leakproof manner;

a seal formed over said seam to seal said seam between and including said base and said tip, said seam thereby becoming leakproof; and wherein said at least one finger cavity comprises at least two adjacent finger cavities sharing a common base, and wherein said seam comprises a seam extending from one of said at least two adjacent finger cavities, through said common base and to the other of said at least two adjacent finger cavities.

35. The hand covering according to claim 34, wherein said seal is discontinuous at said common base, thereby defining two separate seals, said two seals overlapping each other.

36. The hand covering according to claim 35, wherein said two seals overlap each other in a criss-cross pattern.

37. The hand covering according to claim 34, wherein said seal is discontinuous at said tip, thereby defining two separate seals, said two seals overlapping each other.

38. The hand covering according to claim 34, wherein said seal comprises a continuous seal extending between and including said base and said tip along at least one of a first and second sides of said at least one finger cavity.

39. The hand covering according to claim 34, wherein said seal comprises sealing tape.

40. The hand covering according to claim 34, wherein said body cavity and said at least a finger cavity define an outer shell.

41. The hand covering according to claim 40, further comprising an insulating liner disposed within said outer shell.

42. The hand covering according to claim 34, wherein said hand covering comprises a moisture liner-free hand covering.

43. The hand covering according to claim 34, wherein said hand covering is shaped as one of a glove and a mitten.

44. The hand covering according to claim 34, wherein said finger cavity includes a dorsal segment of material joined to a palmar segment of material to form said finger cavity.

45. The hand covering according to claim 44, wherein said finger cavity includes at least one side segment of material joining said dorsal and palmar segments to form said finger cavity.

46. A leakproof hand covering comprising:

a body cavity for covering a palm and a dorsum of a hand;

at least one finger cavity extending from said body cavity for covering at least one finger, said finger cavity formed of at least two segments of material each having a base adjacent said body cavity and a tip opposite said base;

a seam joining said at least two segments of material between and including said base and said tip, said seam joined in a non-leakproof manner;

a seal formed over said seam to seal said seam between and including said base and said tip, said seam thereby becoming leakproof;

wherein said body cavity and said at least one finger cavity define an outer shell; and an insulating liner disposed within said outer shell and substantially conforming to a shape thereof.

47. The hand covering according to claim 46, wherein said seal is discontinuous a said tip, thereby defining two separate seals, said two seals overlapping each other.

48. The hand covering according to claim 46, wherein said seal comprises a continuous seal extending between and including said base and said tip along at least one of a first and second sides of said at least one finger cavity.

49. The hand covering according to claim 46, wherein said seal comprises sealing tape.

50. The hand covering according to claim 46, wherein said hand covering comprises a moisture liner-free hand covering.

51. The hand covering according to claim 46, wherein said hand covering is shaped as one of a glove and a mitten.

52. The hand covering according to claim 46, wherein said finger cavity includes a dorsal segment of material joined to a palmar segment of material to form said finger cavity.

53. The hand covering according to claim 52, wherein said finger cavity includes at least one side segment of material joining said dorsal and palmar segments to form said finger cavity.

54. A hand covering comprising:

a palm surface material having a palmar hand surface portion, shaped to cover the palm of a hand, and at least one palmar finger surface portion extending from the palmar hand surface portion, shape to cover at least one palmar finger surface of a finger;

a dorsal surface material having a dorsal hand surface portion, shaped to cover the dorsum of the hand, and at least one dorsal finger surface portion extending from the dorsal hand surface portion, shaped to cover at least one dorsal finger surface of the finger, said palmar and dorsal surface materials joined together with at least a first seam, said dorsal finger surface and said palmar finger surface defining at least a portion of the hand covering including a thumb cavity separate from the least one finger cavity; and, a second seam formed in at least one of said palmar and dorsal surface materials, wherein the second a extends substantially along the length of the at least one finger cavity.

55. The hand covering according to claim 54, further comprising a first seal formed over said first seam, said first seam thereby becoming leakproof.

56. The hand covering according to claim 55, wherein said first seal is disposed within said finger cavity.

57. The hand covering according to claim 55, wherein said first seal comprises sealing tape.

58. The hand covering according to claim 55, wherein said at least one finger cavity includes a finger tip area and wherein said first seal is discontinuous at said finger tip area, thereby defining two separate seals, said two seals overlapping each other.

59. The hand covering according to claim 55, wherein said at least one finger cavity comprises at least two adjacent finger cavities sharing a common base, and wherein said first seam and said first seal extends from one of said at least two adjacent finger cavities, through said common base and to the other of said at least two adjacent finger cavities.

60. The hand covering according to claim 59, wherein said first seal is discontinuous at said common base, thereby defining two separate seals, said two seals overlapping each other.

61. The hand covering according to claim 60, wherein said two seals overlap each other in a criss-cross pattern.

62. The hand covering according to claim 54, wherein said second seam has a length extending along said length of said at least one of said palmar and dorsal finger surface portions, said length being sufficient to have received a component of a seam sealing machine used to seal said first seam.

63. The hand covering according to claim 54, wherein said at least one finger cavity includes a finger tip area and wherein said first seam joins said palmar finger surface portion and said dorsal finger surface portion at at least said finger tip area, with said second seam extending into said first seam at said finger tip area.

64. The hand covering according to claim 54, further comprising a second seal formed over said second seam, said second seam thereby becoming leakproof.

65. The hand covering according to claim 64, wherein said second seal comprises sealing tape.

66. The hand covering according to claim 54, wherein said body cavity and said at least one finger cavity define an outer shell.

67. The hand covering according to claim 54, wherein said hand covering comprises a moisture liner-free hand covering.

68. The hand covering according to claim 54, wherein said hand covering is shaped as a glove.

69. The hand covering according to claim 54, wherein said hand covering is shaped as a mitten.

70. The hand covering according to claim 54, wherein said dorsal finger surface and said palmar finger surface are joined together to completely form said finger cavity.

71. The hand covering according to claim 54, wherein said finger cavity includes a side segment of material joining said dorsal finger surface and said palmar finger surface to completely form said finger cavity.

72. The hand covering according to claim 54, wherein a first and second side segment of material are each joined to said dorsal finger surface and said palmar finger surface to completely form said finger cavity, with said dorsal finger surface joining said palmar finger surface at a location spaced from said tip.

73. A hand covering comprising:

a palmar surface material having a palmar hand surface portion, shaped to cover the palm of a hand, and least one palmar finger surface portion extending from the palmar hand surface portion, shaped cover at least one palmar finger surface of a finger;

a dorsal surface material having a dorsal hand surface portion, shaped to cover the dorsum of the hand, and at least one dorsal finger surface portion extending from the dorsal hand surface portion, shaped to cover at least one dorsal finger surface of the finger, said palmar and dorsal surface materials joined together with at least a first seam, said dorsal finger surface and said palmar finger surface defining at least a portion of at least one finger cavity;

a second seam formed in at least one of said palmar and dorsal surface materials; and wherein said at least one finger cavity includes a finger tip area and wherein said palmar and dorsal surface are joined together to define a body cavity, said body cavity including a wrist area, with said second seam extending from a position adjacent said finger tip area to a position adjacent said wrist area in at least one of said palmar and dorsal surface materials.

74. The hand covering according to claim 73 further comprising a first seal formed over said first seam, said first seam thereby becoming leakproof.

75. The hand covering according to claim 74, wherein said first seal is disposed within said at least one finger cavity.

76. The hand covering according to claim 74, wherein said first seal comprises sealing tape.

77. The hand covering according to claim 74, wherein said at least one finger cavity includes a finger tip area and wherein said first seal is discontinuous at said finger tip area, thereby defining two separate seals, said two seals overlapping each other.

78. The hand covering according to claim 74, wherein said at least one finger cavity comprises at least two adjacent finger cavities sharing a common base, and wherein said first seam and said first seal extends from one of said at least two adjacent finger cavities, through said common base and to the other of said at least two adjacent finger cavities.

79. The hand covering according to claim 78, wherein said first seal is discontinuous at said common base, thereby defining two separate seals, said two seals overlapping each other.

80. The hand covering according to claim 73, wherein said body cavity and said at least one finger cavity define an outer shell.

81. The hand covering according to claim 80, further comprising an insulating liner disposed within said outer shell.

82. The hand covering according to claim 73, wherein said second seam has a length extending along said length of said at least one of said palmar and dorsal finger surface portions said length being sufficient to have received a component of a seam sealing machine used to seat said first seam.

83. The hand covering according to claim 73, wherein said at least one finger cavity includes a finger tip area and wherein said first seam joins said palmar finger surface portion and said dorsal finger surface portion at at least said finger tip area, with said second seam extending into said first seam at said finger tip area.

84. The hand covering according to claim 73 further comprising a second seal formed over said second seam, said second seam thereby becoming leakproof.

85. The hand covering according to claim 84, wherein said second seal comprises sealing tape.

86. The hand covering according to claim 73, wherein said hand covering comprises a moisture liner-free hand covering.

87. The hand covering according to claim 73, wherein said hand covering is shaped as one of a glove and a mitten.

88. The hand covering according to claim 73, wherein said dorsal finger surface and said palmar finger surface are joined together to form said finger cavity.

89. The hand covering according to claim 88, wherein said finger cavity includes at least one side segment of material joining said dorsal finger surface and said palmar finger surface to form said finger cavity.

90. A hand covering comprising:

a palmar surface material having a palmar hand surface portion, shaped to cover the palm of a hand, an at least one palmar finger surface portion extending from the palmar hand surface portion, shaped to cover at least one palmar finger surface of a finger;

a dorsal surface material having a dorsal hand surface portion, shaped to cover the dorsum of the hand, and at least one dorsal finger surface portion extending from the dorsal hand surface portion, shaped to cover at least one dorsal finger surface of the finger, said palmar and dorsal surface materials joined together with at least a first seam, said dorsal finger surface and said palmar finger surface defining at least a portion of at least one finger cavity;

a second seam formed in at least one of said palmar and dorsal surface materials;

where said body cavity and said at least one finger cavity define an outer shell; and an insulating liner disposed within said outer shell substantially conforming to a shape thereof.

91. The hand covering according to claim 90 further comprising a first seal formed over said first seam, said first seam thereby becoming leakproof.

92. The hand covering according to claim 91, wherein said first seal is disposed within said at least one finger cavity.

93. The hand covering according to claim 91, wherein said first seal comprises sealing tape.

94. The hand covering according to claim 91, wherein said at least one finger cavity includes a finger tip area and wherein said first seal is discontinuous at said finger tip area, thereby defining two separate seals, said two seals overlapping each other.

95. The hand covering according to claim 91, wherein said at least one finger cavity comprises at least two adjacent finger cavities sharing a common base, and wherein said first seam and said first seal extends from one of said at least two adjacent finger cavities, through said common base and to the other of said at least two adjacent finger cavities.

96. The hand covering according to claim 95, wherein said first seal is discontinuous at said common base, thereby defining two separate seals, said two seals overlapping each other.

97. The hand covering according to claim 90, wherein said second seam has a length extending along said length of said at least one of said palmar and dorsal finger surface portions, said length being sufficient to have received a component of a seam sealing machine used to seal said first seam.

98. The hand covering according to claim 90, wherein said at least one finger cavity includes a finger tip area and wherein said first seam joins said palmar finger surface portion and said dorsal finger surface portion at at least said finger tip area, with said second seam extending into said first seam at said finger tip area.

99. The hand covering according to claim 90 further comprising a second seal formed over said second seam, said second seam thereby becoming leakproof.

100. The hand covering according to claim 99, wherein said second seal comprises sealing tape.

101. The hand covering according to claim 90, wherein said hand covering comprises a moisture liner-free hand covering.

102. The hand covering according claim 90, wherein said hand covering is shaped as one of a glove and a mitten.

103. The hand covering according to claim 90, wherein said dorsal finger surface and said palmar finger surface are joined together to form said finger cavity.

104. The hand covering according to claim 103, wherein said finger cavity includes at least one side segment of material joining said dorsal finger surface and said palmar finger surface to form said finger cavity.

105. A hand covering comprising:

a palmar surface material having a palmar hand surface portion, shaped to cover the palm of a hand, and at least one palmar finger surface portion extending from the palmar hand surface portion, shape to cover at least one palmar finger surface of a finger;

a dorsal surface material having a dorsal hand surface portion, shaped to cover the dorsum of the hand, and at least one dorsal finger surface portion extending from the dorsal hand surface portion shaped to cover at least one dorsal finger surface of the finger, said palmar and dorsal surface materials joined together with at least a first seam, said dorsal finger surface and said palmar finger surface defining at least a portion of one finger cavity;

a second seam formed in at least one of said palmar and dorsal surface materials; and wherein a first and second side segment of material are each joined to said dorsal finger surface and said palmar finger surface to completely form said at least one finger cavity.

106. The hand covering according to claim 105 further comprising a first seal formed over said first seam, said first seam thereby becoming leakproof.

107. The hand covering according to claim 106, wherein said first seal is disposed within said finger cavity.

108. The hand covering according to claim 106, wherein said first seal comprises sealing tape.

109. The hand covering according to claim 106, wherein said at least one finger cavity includes a finger tip area and wherein said first seal is discontinuous at said finger tip area, thereby defining two separate seals, said two seals overlapping each other.

110. The hand covering according to claim 106, wherein said at least one finger cavity comprises at least two adjacent finger cavities sharing a common base, and wherein said first seam and said first seal extends from one of said at least two adjacent finger cavities, through said common base and to the other of said at least two adjacent finger cavities.

111. The hand covering according to claim 110, wherein said first seal is discontinuous at said common base, thereby defining two separate seals, said two seals overlapping each other.

112. The hand covering according to claim 105, wherein said body cavity and said at least one finger cavity define an outer shell.

113. The hand covering according to claim 112, further comprising an insulating liner disposed within said outer shell.

114. The hand covering according to claim 105, wherein said second seam has a length extending along said length of said at least one of said palmar and dorsal finger surface portions, said length being sufficient to have received a component of a seam sealing machine used to seal said first seam.

115. The hand covering according to claim 105, wherein said at least one finger cavity includes a finger tip area and wherein said first seam joins said palmar finger surface portion and said dorsal finger surface portion at at least said finger tip area, with said second seam extending into said first seam at said finger tip area.

116. The hand covering according to claim 105 further comprising a second seal formed over said second seam, said second seam thereby becoming leakproof.

117. The hand covering according to claim 116, wherein said second seal comprises sealing tape.

118. The hand covering according to claim 105, wherein said hand covering comprises a moisture liner-free hand covering.

119. The hand covering according to claim 105, wherein said hand covering is shaped as one of a glove and a mitten.

* * * * *